US007213996B1

(12) United States Patent
Chen

(10) Patent No.: US 7,213,996 B1
(45) Date of Patent: May 8, 2007

(54) WRITING IMPLEMENT WITH ORNAMENT

(76) Inventor: Chung-Ping Chen, No. 19, Lane 49, Dong Feng Street, Shu-Lin City, Taipei Shien (TW)

( * ) Notice: Subject to any disclaimer, the term of this patent is extended or adjusted under 35 U.S.C. 154(b) by 0 days.

(21) Appl. No.: 11/361,095

(22) Filed: Feb. 23, 2006

(51) Int. Cl.
*B43K 29/00* (2006.01)

(52) U.S. Cl. ..... 401/195

(58) Field of Classification Search ..... 401/195, 401/52, 99, 103
See application file for complete search history.

(56) References Cited

U.S. PATENT DOCUMENTS 5,158,384 A * 10/1992 Radmilovic et al. ..... 401/195
6,332,727 B1 * 12/2001 Hsu ..... 401/195
6,971,812 B1 * 12/2005 Chen ..... 401/195

* cited by examiner

*Primary Examiner*—David J. Walczak
(74) *Attorney, Agent, or Firm*—Pro-Techtor Int'l Services

(57) ABSTRACT

A writing implement with ornament having an ornament plate assembled from a body and a cover plate installed on a penholder of a conventional writing implement. A slide piece, a set of gears and an ornament member are installed interior of the ornament plate. When writing with the writing implement and pressing down on the penpoint, the pen refill pushes the slide piece upward, which rotates the set of gears and compresses a spring, thereby effecting vertical displacement of an ornament on the ornament member.

1 Claim, 4 Drawing Sheets

WRITING IMPLEMENT WITH ORNAMENT

BACKGROUND OF THE INVENTION (a) Field of the Invention

The present invention relates to a writing implement with ornament, and more particularly to an ornament plate assembled from a body and a cover plate disposed on a top end of a writing implement. Interior of the ornament plate is provided with a slide piece, and an ornament member is located on the slide piece. Writing with the writing implement and pressing down on the penpoint effects vertical displacement of an ornament located on the ornament member, thereby achieving an amusing effect when writing.

(b) Description of the Prior Art

A conventional pen is limited to being used to write with, and lacks any additional functions. Hence, in order to increase the fun of writing with a pen, some manufacturers have installed an ornament on top of the pen, such as a puppet, a cartoon character, a feather-like object, and so on. However, all such ornaments are designed to be stationary, lacking any animation, and thus unable to provide any animated movement when writing with the pen.

SUMMARY OF THE INVENTION

The primary object of the present invention is to install an ornament plate assembled from a body and a cover plate on a penholder of a conventional writing implement. Interior of the ornament plate is provided with a slide piece, a set of gears and an ornament member. When writing with the writing implement and pressing down on the penpoint, the slide piece upwardly displaces, and meshing of racks and a set of gears is used to effect vertical displacement of an ornament located on the ornament member. With such a configuration, a light touch on the penpoint of the writing implement is able to cause the ornament to protrude from the ornament plate, and release of pressure on the pinpoint enables the ornament to retract back into the ornament plate, thereby achieving an amusing effect when writing.

To enable a further understanding of said objectives and the technological methods of the invention herein, brief description of the drawings is provided below followed by detailed description of the preferred embodiments.

DETAILED DESCRIPTION OF THE PREFERRED EMBODIMENTS

Figure 1:
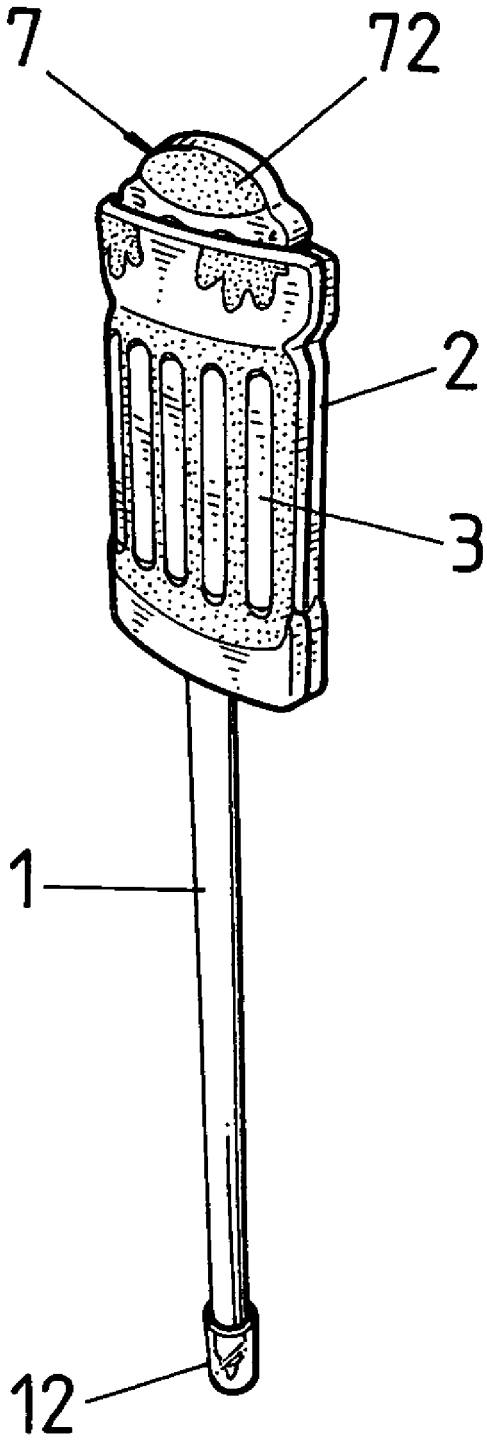
FIG. 1 shows an elevational schematic view of the present invention.
Figure 2:
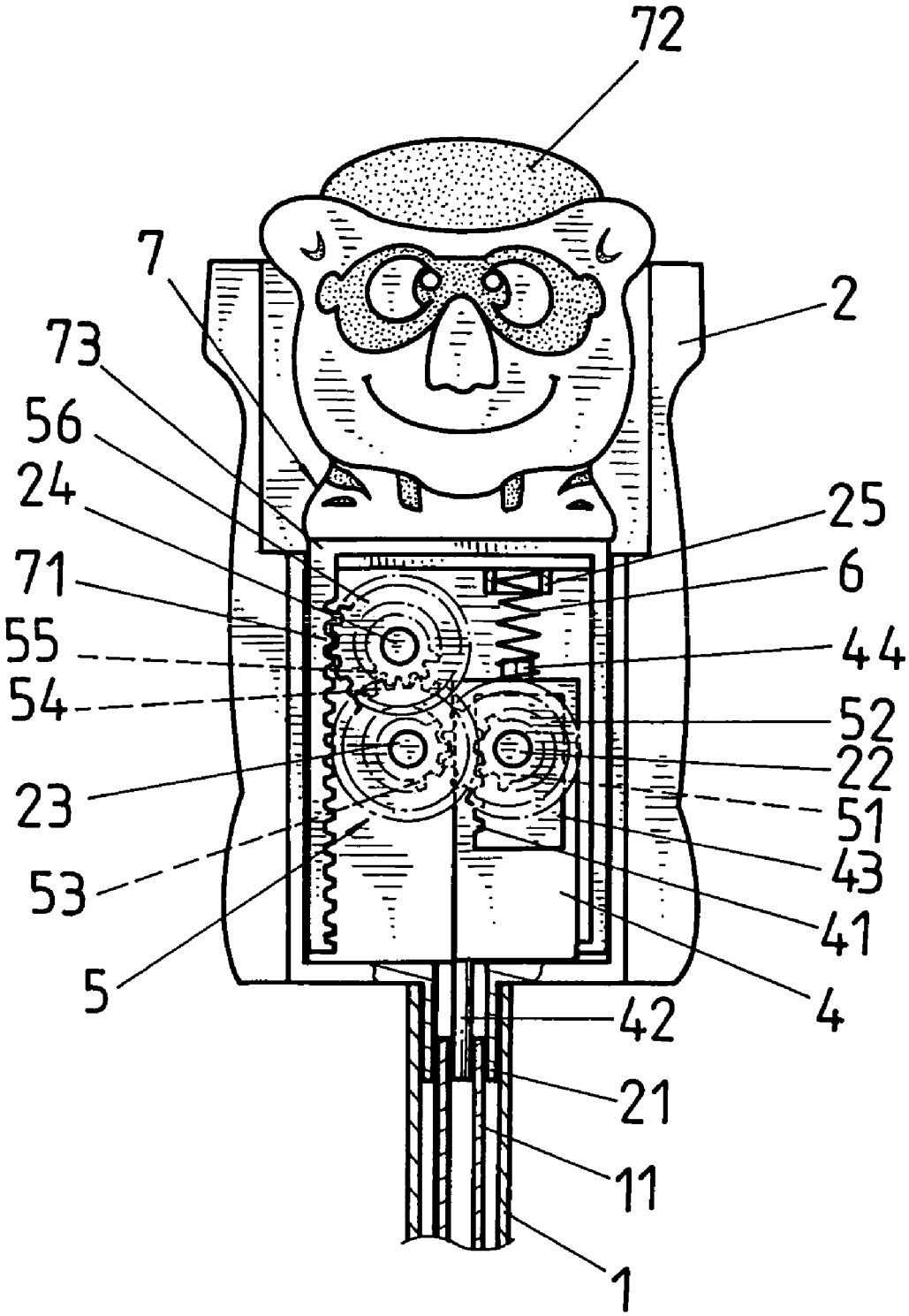
FIG. 2 shows a cutaway view of the present invention.

Referring to FIGS. 1 and 2, which show the present invention structured to comprise a penholder 1, a body 2, a cover plate 3, a slide piece 4, a set of gears 5, a spring 6 and an ornament member 7, wherein an interior of the penholder 1 is provided with a pen refill 11, and a bottom portion of the penholder 1 is provided with a cap 12. A bottom portion of the body 2 is provided with a sleeve 21, which is assembled to the cover plate 3 to form an ornament plate having an open top end. Interior of the ornament plate provides for the slide piece 4, the set of gears 5, the spring 6 and the ornament member 7 to be disposed therein.

A protruding rod 42 protrudes from a bottom end of the slide piece 4 and extends into the sleeve 21 of the body 2. Moreover, a slot 43 is defined in an inner side of the slide piece 4, and a rack 41 is formed on a side edge of the slot 43. A clasp post 44 is located on an outer side of a top end of the slot 43.

Three protruding posts 22, 23 and 24 are located within the body 2, which enable the set of gears 5 to be respectively pivot joined thereto. The protruding post 22 is positioned within the aforementioned slot 43 of the slide piece 4, and the other two protruding posts 23, 24 are positioned outside of the slot 43 of the slide piece 4. The protruding post 22 penetrates a small gear 51 and a large gear 52, which are coaxially configured. The small gear 51 meshes with the rack 41 formed on the side edge of the slot 43, and the large gear 52 meshes with a small gear 53 pivot joined to the other protruding post 23. The small gear 53 and a large gear 54 are coaxially configured, and the large gear 54 meshes with a small gear 55 pivot joined to the protruding post 24. A large gear 56 and the small gear 55 are coaxially configured, and the large gear 56 meshes with a rack 71 formed on an extended section of a lower portion of the ornament member 7 provided with an ornament 72. The lower portion of the ornament member 7 is a squared-off inverted U-shaped plate 73. The rack 71 is formed on a side edge of the squared-off inverted U-shaped plate 73 extended section close to the large gear 56; Moreover, the ornament 72, which is not fixed to any specifically designated design, is positioned on a top end of the aforementioned squared-off inverted U-shaped plate 73. Furthermore, a groove 25 is additionally defined interior of the body 2 corresponding to an upper portion of the clasp post 44 of the slide piece 4, thereby enabling the spring 6 to be clamped between the clasp post 44 and the groove 25.

Figure 3:
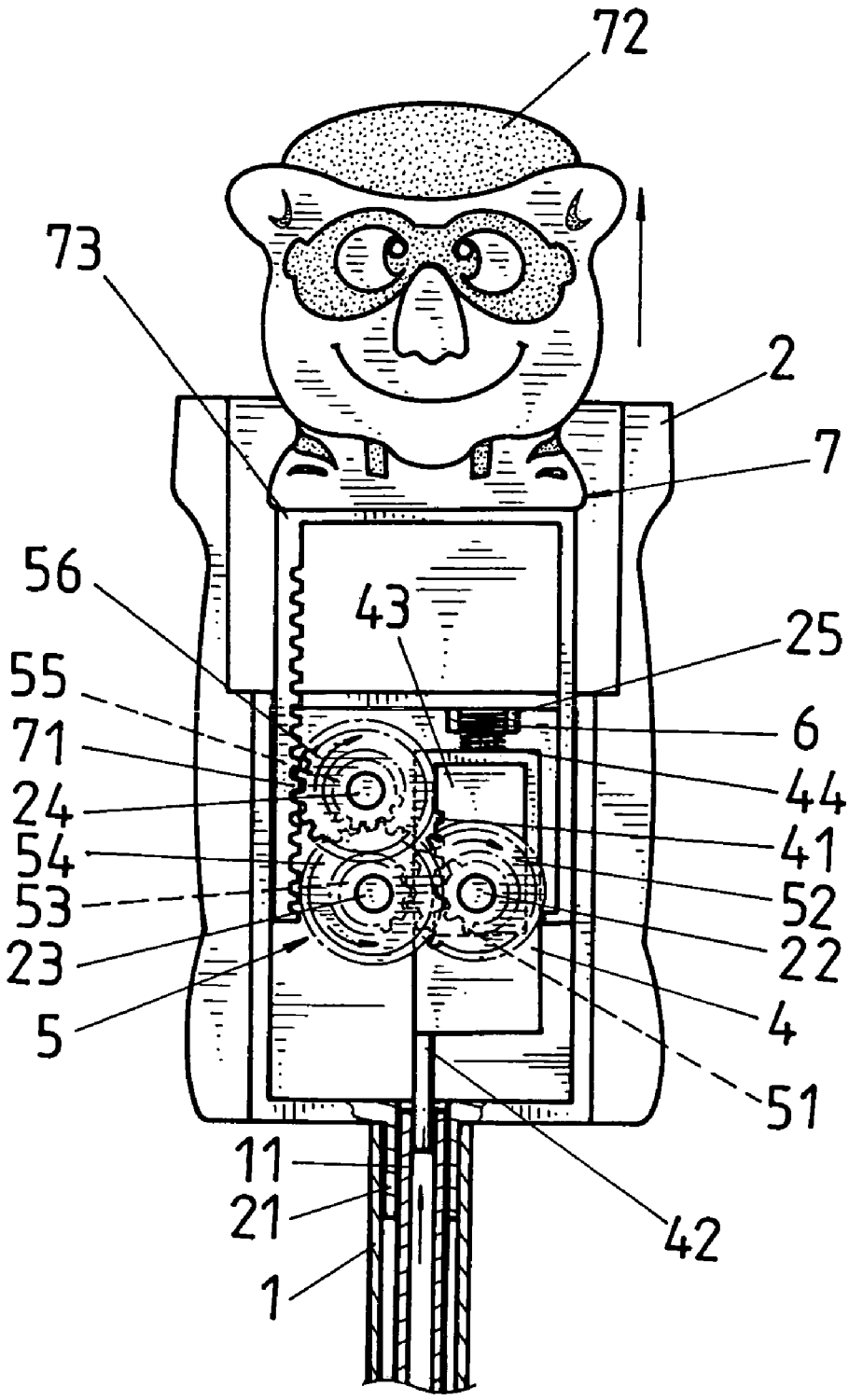
FIG. 3 shows a cutaway schematic view of motion of the present invention.

Referring to FIG. 3, when the cap 12 is removed from the penholder 1, and a user is writing with the writing implement of the present invention, pressure applied to the penpoint causes the pen refill 11 to slide within the sleeve 21 of the body 2, which simultaneously upwardly pushes the protruding rod 42 of the slide piece 4, thereby upwardly displacing the slide piece 4 and compressing the spring 6, which enables the rack 41 to actuate and rotate the set of gears 5 that further drive the rack 71 located below the ornament component member 7, thus effecting a sliding movement of the ornament member 7, and causing the ornament 72 located on the top end of the ornament member 7 to protrude out from a top portion of the body 2 (ornament plate). Furthermore, when the external force being applied to the penpoint is released, because of the restoring effect of the spring 6, thus, the slide piece 4 is forced downward and drives the set of gears 5 in reverse, which downwardly displaces the ornament member 7 to its original position, thereby enabling the ornament 72 to retract back into the body 2 (ornament plate).

Figure 4:
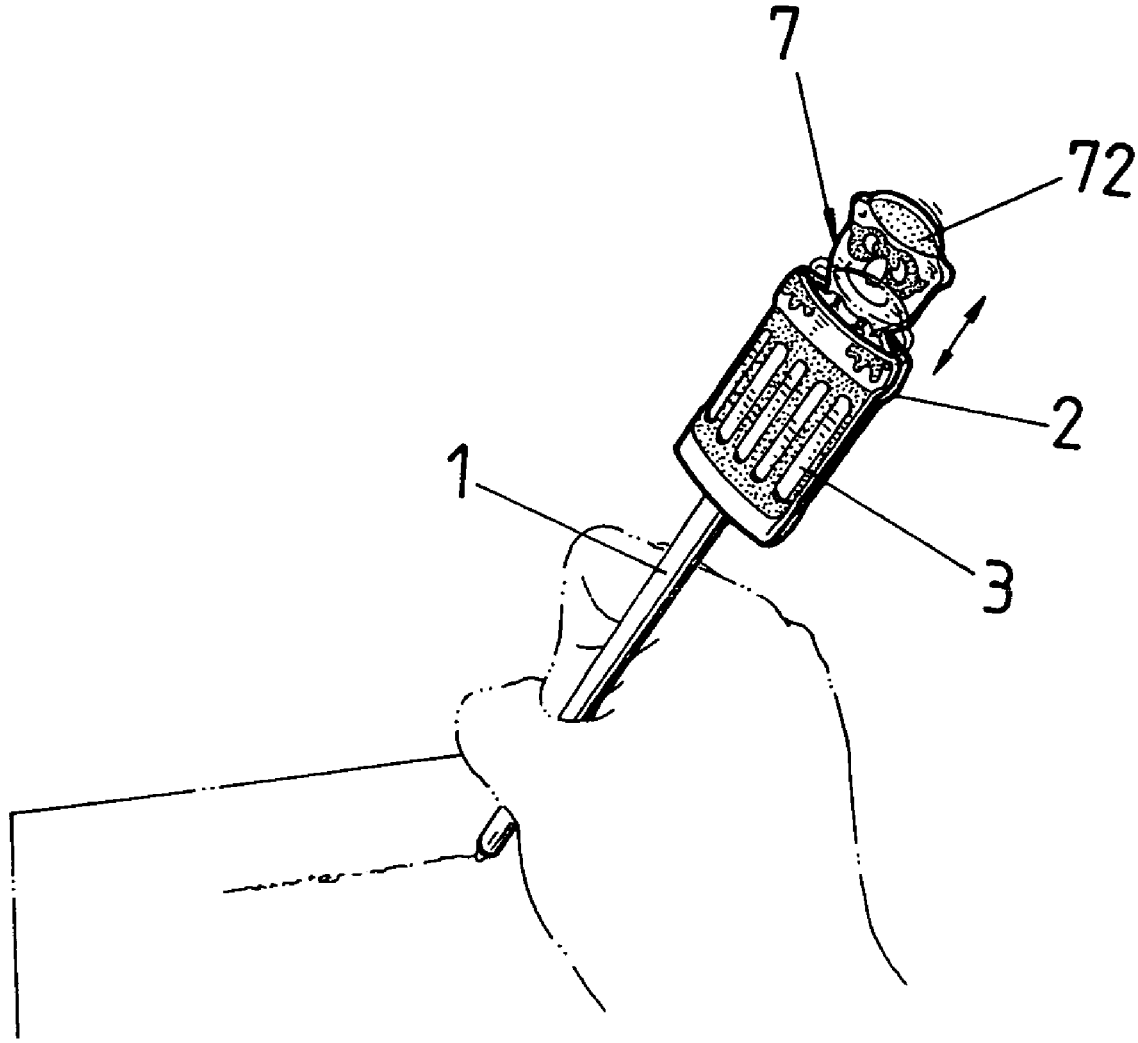
FIG. 4 shows a schematic view of the present invention in use.

Referring to FIG. 4, when holding the penholder 1 and writing with the writing implement of the present invention, touching a piece of paper with the penpoint of the penholder 1 causes the ornament 72 to protrude outward from the ornament plate, and when the user stops writing, the ornament 72 retracts back into the ornament plate. By such means the ornament 72 repeatedly protrudes from and retracts back into the ornament plate.

In conclusion, the present invention uses the slide piece 4 and the set of gears 5 to cause the ornament 72 to slide repeatedly up and down within the ornament plate, thereby providing a new, enhanced experience when writing and deliberating over word processing tasks. Furthermore, the present invention has a configuration comprising structurally assembled coordination between the racks 41, 71 and the set of gears 5, which is able to increase stability of the ornament 72 when being vertically displaced.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A writing implement with ornament, comprising a penholder, interior of which is provided with a pen refill, and a bottom of the penholder is covered with a cap; the writing implement with ornament is characterized in that:

a body, a lower portion of which is provided with a sleeve, and an interior of the body is provided with three protruding posts and a groove;

a cover plate, which is assembled together with the body to form an ornament plate having an open top end;

a slide piece, a bottom end of which protrudes a protruding rod, and the protruding rod extends into the sleeve of the body, a slot is defined in an inner side of the slide piece, and a rack is formed on a side edge of the slot, moreover, a clasp post is located on an outer side of a top end of the slot corresponding to the groove of the body;

a set of gears joined to said protruding posts;

a spring that clamps between the clasp post of the slide piece and the groove of the body;

an ornament member, a top end of which is provided with an ornament, a lower portion of the ornament member is a squared-off inverted U-shaped plate, and a rack is formed on a side edge of an extended section of the squared-off inverted U-shaped plate;

when writing with the writing implement assembled from the aforementioned component members, the pen refill slides within the sleeve of the body, which simultaneously upwardly pushes the protruding rod of the slide piece and compresses the spring, which enables the rack of the slide piece to actuate and rotate the set of gears, thereby effecting a vertical sliding movement of the ornament member that enables the ornament located on the top end of the ornament member to protrude out from a top portion of the ornament plate and to retract into the ornament plate.

* * * * *